United States Patent [19]

Anderié et al.

[11] Patent Number: 4,970,807

[45] Date of Patent: Nov. 20, 1990

[54] OUTSOLE FOR SPORTS SHOES

[75] Inventors: Wolf Anderié; Franz Schacher, both of Herzogenaurach, Fed. Rep. of Germany

[73] Assignee: Adidas AG, Fed. Rep. of Germany

[21] Appl. No.: 397,427

[22] PCT Filed: Dec. 16, 1988

[86] PCT No.: PCT/DE88/00767

§ 371 Date: Aug. 9, 1989

§ 102(e) Date: Aug. 9, 1989

[87] PCT Pub. No.: WO89/05593

PCT Pub. Date: Jun. 29, 1989

[30] Foreign Application Priority Data

Dec. 17, 1987 [DE] Fed. Rep. of Germany ..... 3742720
Jan. 29, 1988 [DE] Fed. Rep. of Germany ..... 3802607

[51] Int. Cl.[5] ..... A43B 13/20; A43B 21/26

[52] U.S. Cl. ..... 36/28; 36/35 R; 36/37

[58] Field of Search ..... 36/28, 29, 7.8, 27, 36/35 R, 35 B, 37, 38; 5/455, 476

[56] References Cited

U.S. PATENT DOCUMENTS

| | | | |
|---|---|---|---|
| 1,012,597 | 12/1911 | Church | 36/35 R |
| 1,516,395 | 11/1924 | Miceli | 36/7.8 |
| 2,495,124 | 1/1950 | Morner | 5/455 |
| 2,885,797 | 5/1959 | Chrencik | 36/28 |
| 4,316,332 | 2/1982 | Gese | 36/28 |
| 4,472,890 | 9/1984 | Gilbert | 36/35 B |
| 4,658,515 | 4/1987 | Oatman | 36/35 R |
| 4,750,224 | 6/1988 | Strackle | 5/455 |
| 4,779,359 | 10/1988 | Famolare et al. | 36/29 |
| 4,821,354 | 4/1989 | Little | 5/455 |

FOREIGN PATENT DOCUMENTS

| | | | |
|---|---|---|---|
| 8626991 | 1/1987 | Fed. Rep. of Germany . | |
| 3619387 | 10/1987 | Fed. Rep. of Germany . | |
| 800207 | 6/1936 | France . | |
| 268021 | 9/1929 | Italy | 36/35 R |
| 284336 | 4/1931 | Italy | 36/35 B |
| 13911 | of 1893 | United Kingdom | 36/29 |
| 23667 | of 1894 | United Kingdom | 36/29 |
| 223748 | 11/1924 | United Kingdom . | |
| 2203025 | 10/1988 | United Kingdom | 36/28 |
| 2206475 | 1/1989 | United Kingdom | 36/29 |

*Primary Examiner*—Steven N. Meyers

[57] ABSTRACT

An outsole of flexible plastic material for sports shoes with a recess (4) beneath the heel support surface (A) for accommodating a plurality of individual bodies (5) comprising a resilient material, which fill the recess and which in the non-loaded condition bear against each other only in a region-wise or point-wise manner, forming spaces therebetween. The individual bodies (5) may be in the form of balls and may be joined together by a matrix of small connecting limb portions, to provide for better handling.

7 Claims, 1 Drawing Sheet

OUTSOLE FOR SPORTS SHOES

Figure 3:
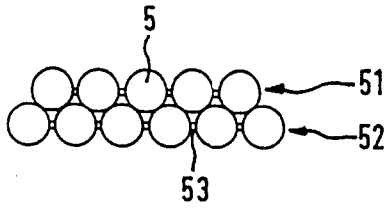

The invention relates to an outsole of flexible plastic material for sports shoes.

The problem of so constructing the outsole of sports shoes that they adequately absorb (damp) the high loadings on the motor apparatus of the runner, which loadings occur practically in the form of impacts due to the foot being set down, while at the same time not adversely affecting the natural running style and performance has been the subject of numerous proposals and practical design configurations. It will be appreciated that the principal loading when the foot is put down occurs in the heel region as at least the average runner first puts his foot to the ground at that location, so that for a short period in the rolling has to take account of the different bodyweights of runners, as clearly an outsole which gives an adequate spring travel and thus an adequate damping effect for a heavy runner is too hard for a light runner while an outsole which suits a light runner is excessively compressed by the sole loadings applied by a heavy runner and therefore produces the above-mentioned floating feel or 'bottoms out'. There are therefore many outsoles of the kind set forth in the opening part of this specification which, for individual adaptation of the damping capacity of the outsole to the different bodyweights of runners, have support bodies or the like which can be interchangeably fitted into recesses under the heel support surface (see German published specification (DE-AS) No. 29 04 540; German laid-open application (DE-OS) No. 32 45 964). However those known constructions assume that the runner himself is capable of determining the damping effect which he requires, that is to say, the runner can himself make the choice in respect of the damping bodies which are required for that purpose, which however is in no way always the case.

It is also known that the spring resiliency of the materials of the known outsoles produces what is known as a 'catapult effect' in that in proportion to the local reduction in loading during the rolling movement of the foot, the sole accelerates the foot in an upward direction, with a force corresponding to compression of the sole. Although that catapult effect is considered as contributing towards running efficiency, in a pronounced form it is disadvantageous from the point of view of health as, when the loading impressed on the sole is restored with full resiliency, the sole 'strikes back' at the foot with the same force as that with which it had been previously loaded when the foot was put down on the ground. That gives rise in particular to damage in the region of the achilles tendons and the knee joints.

The object of the present invention is therefore to provide an outsole of the kind set forth in the opening part of this specification, which permits adaptation of the damping capability of the outsole to different runner bodyweights in a simpler fashion, without the runner himself having to take action in that respect. In addition the invention seeks to provide that the outsole cuts down on the loading peaks which are harmful to health, due to the catapult effect.

The fact that the damping body comprises a plurality of individual bodies of a resilient material, which in the non-loaded condition bear against each other only in a region-wise or point-wise manner and which can lie directly against each other or which are connected together by interposed resilient material provides a progressive spring characteristic. In that respect the invention is based on the consideration which is known in principle that a progressive spring characteristic in respect of the resilient damping body causes it automatically to provide for adaptation to different runner bodyweights. For, at a low level of loading, an adequate spring travel can be achieved by virtue of the soft springing effect which occurs in that situation while the increase in spring travel with increasing loading becomes progressively less in accordance with the progressively rising spring characteristic, so that a heavy runner, with the heel, compresses the outsole to a relatively lesser degree. In that sense, a damping body comprising a plurality of small individual bodies is found to be a surprisingly simple construction to provide a progressive spring characteristic. For the individual bodies which are preferably balls but which may also be cubes, cylinders, parallelepipededs or other symmetrical or asymmetrical structures only bear against each other in a point-wise, line-wise or region-wise manner, by virtue of their configuration, in the non-loaded condition in which they normally entirely fill the recess under the heel support surface. As a result of that arrangement, they form intermediate spaces in the damping body which is formed by the individual bodies as an assembly. As a result of that contact with each other over only a small area, the loading applied thereto is divided up into a corresponding plurality of individual forces which initially result in locally high deformation of the individual bodies. With increasing deformation however the contact and support areas between the individual bodies increase so that the flexibility of the damping body becomes progressively less. It is only at the time at which the elastic deformation of the individual bodies means that all the spaces therebetween have been closed up, that is to say the individual bodies are in a 'blocked' condition against each other, that the damping body generally behaves like a compact resilient body with an approximately linear spring characteristic.

The progressive nature of the spring characteristic of the damping body according to the invention may be determined by the choice of the size of the individual bodies. Desirably the limits of the principal transverse dimension of the diameter of the individual bodies are 2 and 12 mm. However a size of from 3 to 8 mm is preferred.

The progressive spring characteristic of the damping body which can be achieved in a simple manner by virtue of that arrangement involves a significant further advantage of that construction. As the individual bodies can also move relative to each other in the recess when a loading occurs, a part of the applied kinetic energy is converted into friction. That provides that, when the damping body is relieved of load, it does not restore the force acting thereon to the heel of the runner in its entirety, but restores that force only to a somewhat lower degree. Although that causes a reduction in the normally desired catapult effect which as the rolling phase of the foot progresses accelerates the runner somewhat upwardly again, it has been found that a fully resilient spring characteristic in respect of the damping body which, when relieved of load, fully restores again to the heel the force which had been previously absorbed, can have disadvantageous consequences in terms of health, in the region of the heel and achilles tendon. The fact that, in the damping body according to the invention, the individual bodies must first move back into their initial position again, by suitably overcoming friction, at the time that and after the load thereon is removed, provides that the above-mentioned catapult effect is moderated, with positive consequences. That also applies if, for reasons of expedience, the individual bodies are lightly bound together by a bonding or adhesive agent for the sake of improved handling in the course of the process for the production of the outsole, or are even fixed relative to each other in one piece with and in a thin membrane. For, the bonding or adhesive agent which may be for example a silicone rubber or the membrane consisting of the same material as the individual bodies is itself resiliently yielding to a considerable degree and essentially only prevents the individual bodies from falling apart, without however preventing relative mobility thereof.

As already mentioned, for the purposes of better handling, the individual bodies such as for example balls may be formed in one piece with a thin membrane which fixes them at such a small spacing from each other that there are at most minute bridges between the individual bodies. In the case of individual bodies with a surface which is curved in all directions, for example balls, however, when they are fixed by means of a membrane, it is possible for the balls to bear directly against each other as the membrane only needs to extend through the spaces between the balls, which exist in any case by virtue of the shape thereof. In order not to have an adverse effect on the desired relative mobility of the individual bodies, and the intermediate spaces formed by same, the membrane should be very thin, for example being of a thickness of only a few tenths of a millimetre.

Instead of a membrane, the desired effect of binding the individual bodies to each other may also be produced by minute bridges in rod-like or ring-like form, which can also be produced in one piece with the individual bodies for example by an an injection moulding process. Both the membrane and also the bridge-like matrix may be of a flat or three-dimensional configuration. A flat configuration in which the individual bodies also correspondingly lie in one plane is advantageous insofar as by virtue of that arrangement the damping body can be generally built up by means of a plurality of layers of the individual bodies which are bound together in that fashion.

Figure 1:
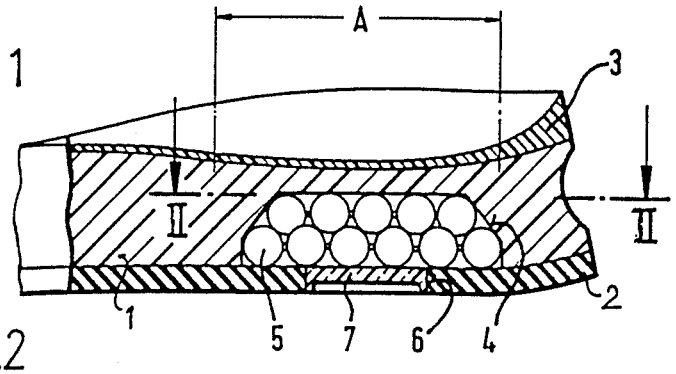
Figure 2:
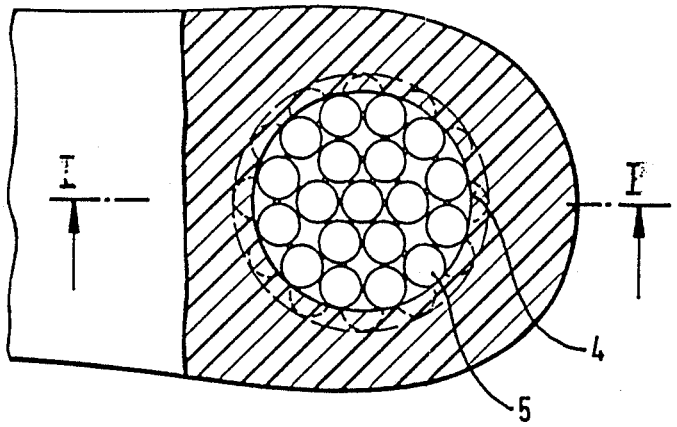

An embodiment of the invention is described in greater detail hereinafter with reference to the accompanying drawings in which:

FIG. 1 shows an outsole according to the invention in longitudinal section in part in the heel region, along line I—I in FIG. 2, FIG. 2 is a plan view of the outsole shown in FIG. 1, in section in the heel region along line II—II in FIG. 1, and FIG. 3 is a detail view of a damping body in accordance with the invention, in which the individual bodies are bound together.

The outsole illustrated in the drawings comprises an intermediate sole 1 of elastic plastic material, for example polyurethane with a Shore A hardness of 25 to 65 (corresponding to Shore C of from 40 to 80), a wearing sole 2 which is joined thereto on the downward side and which comprises for example rubber and which may have a profiled sole pattern (not shown), and a heel bed cup 3 which is joined to the foot side of the intermediate sole 1 in the heel region and which may be of a Shore hardness of the same order of magnitude as the intermediate sole 1 or somewhat higher.

A recess 4 is formed in the intermediate sole 1 beneath the heel support surface, that is to say the region indicated at A in FIG. 1, in which the heel bone of the runner applies a loading to the heel bed cup 3. The recess 4 extends upwardly from the junction surface between the wearing sole 2 and the intermediate sole 1. In the intermediate sole 1 the recess 4 terminates at a spacing of only about 0 to 2 mm before the junction surface between the heel bed cup 3 and the intermediate sole 1. The diameter of the recess 4 in the illustrated embodiment is about 3.5 to 4 cm; its height is about 12.5 to 13 mm.

The recess 4 is filled with a plurality of small balls 5 of an elastomer material of high elasticity, for example polyurethane or rubber. The balls 5 have a substantially smooth outside surface so that when a loading occurs the balls cannot become hooked into each other but even when subjected to a loading only bear against each other or even enjoy a certain degree of relative mobility. Although this is not shown in detail in the drawings, the balls 5 may be sprayed with an adhesive or binding agent, for example a silicone rubber solution, prior to the balls being assembled to provide a damping body corresponding to the shape of the recess 4, so that the balls 5 adhere to each other and can be fitted into the recess 4 in the form of a self-contained damping body in the process for the production of the outsole, that is to say, prior to the wearing sole 2 being fitted on to the intermediate sole 1.

The recess 4 is closed on its underside by the wearing sole 2. An opening 6 may be provided in the wearing sole 2 in the region of the recess 4. The opening 6 is closed by a transparent plate 7, possibly comprising a harder material than the sole 2.

FIG. 3 shows a damping body comprising two layers 51 and 52 of balls. Each of the two layers 51 and 52 of balls is formed by balls 5 which are disposed in a plane being bound together by very small connecting limb portions 53 which are formed in one piece with the balls, for example by injection moulding. The balls are held by that matrix of connecting limb portions 53 in such a way that each layer of balls 52 can be easily handled. In the illustrated embodiment both layers 51 and 52 are of a substantially circular outline, of a size such that they fit into and substantially fill the recess 4 which is of an appropriate configuration (see FIG. 1). In that arrangement the upper layer 51 of balls has a ball at the centre point of the circle while the centre point of the lower layer 52 of balls is unoccupied. In that way the balls of the two layers are in mutually displaced relationship relative to each other as the balls are of the same size, thus providing the frustoconical configuration of the damping body which can be seen from FIGS. 1 and 3. The shape of the recess 4 matches that frustoconical configuration.

In the embodiment shown the balls are about 7 mm in diameter, the total number of balls in the damping body accordingly being about 40.

When a loading occurs while the person wearing the shoe is running, a compression force is applied to the accumulation of balls 5 by way of the part of the heel bed cup 3 which is over the recess 4, and possibly the remaining wall portion of the intermediate sole 1. Starting from the centre of the loading, that is to say normally the lower apex point of the heel bone, that compression force results in the balls 5 being increasingly pressed against each other downwardly and in a radial direction. That produces a spring travel while a return force corresponding to the loading takes effect, by virtue of the elasticity of the balls 5. With an increasing loading, the reaction force of the balls becomes progressively greater, as referred to hereinbefore, so that the spring travel is not linear in relation to the loading, but the increase in spring travel falls with increasing loading.

Alterations may be made in the above-described embodiments without departing from the scope of the invention. Thus for example the shape of the recess in which the damping body is disposed may be of any nature and instead of being circular in cross-section may have a base surface which is oval or with a polygonal edge. In addition the friction which occurs between the individual bodies, being balls in the present case, may be intentionally controlled in that the surface thereof is deliberately kept rough or less rough. With a greater degree of roughness and consequently increased level of friction, the balls absorb more energy and thereby reduce the peak force involved in the catapult effect, to a greater degree. It will further be appreciated that, even when the balls are arranged in a matrix, the damping body is not restricted to the configuration shown in FIG. 3.

We claim:

1. An outsole of flexible plastic material for sports shoes, having a recess which is disposed under a wearer's heel and confined to a heel support surface of the outsole supporting said heel, for accommodating a resiliently, compressible damping body, wherein said damping body comprises at least two separate layers each of a plurality of solid balls made of a resilient material, the balls substantially filling said recess, the layers being arranged one above the other and the balls in the respective layers being connected together and forming interstices between them and arranged in such a way that the balls of one layer are displaced with respect to the balls of the other layer so as to intrude into the respective interstices and to contact each other, in an non-loaded condition of the outsole, in a point-wise manner, whereby, when the damping body is compressed under the wearer's heel, the balls of the respective layers intrude more deeply into said interstices and frictionally engage each other when intruding, thereby dissipating by friction part of the energy imparted by compression.

2. An outsole according to claim 1, wherein the principal transverse dimension or the diameter of the balls is from 2 to 12 mm, preferably from 3 to 8 mm.

3. An outsole according to claim 1 or 2, wherein the balls are bound together by bonding or adhesive agent.

4. An outsole according to claim 1 or 2, wherein the balls are connected together by small limb portions or bridges.

5. An outsole according to claim 4, wherein the limb portions or bridges are in one piece with the balls.

6. An outsole according to claim 1 or 2, wherein the recess is in the form of a circular cylinder with its axis perpendicular to the ground-engaging surface of the outsole.

7. An outsole according to claim 1 or 2, wherein the damping body is substantially of frustoconical configuration and the recess is matched to the configuration of the damping body.

* * * * *